US011022944B2

(12) United States Patent
Rochat

(10) Patent No.: US 11,022,944 B2
(45) Date of Patent: Jun. 1, 2021

(54) FIXING DEVICE FOR A BRACELET

(71) Applicant: Montres Breguet S.A., L'Abbaye (CH)

(72) Inventor: Fabrice Rochat, Vallorbe (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 16/642,225

(22) PCT Filed: Aug. 8, 2018

(86) PCT No.: PCT/EP2018/071553
§ 371 (c)(1),
(2) Date: Feb. 26, 2020

(87) PCT Pub. No.: WO2019/076509
PCT Pub. Date: Apr. 25, 2019

(65) Prior Publication Data

US 2020/0183334 A1 Jun. 11, 2020

(30) Foreign Application Priority Data

Oct. 20, 2017 (EP) ..... 17197553

(51) Int. Cl.
*G04B 37/14* (2006.01)
*A44C 5/14* (2006.01)

(52) U.S. Cl.
CPC ..... *G04B 37/1493* (2013.01); *A44C 5/14* (2013.01)

(58) Field of Classification Search
CPC .... G04B 37/1493; G04B 37/1486; A44C 5/14
See application file for complete search history.

(56) References Cited

U.S. PATENT DOCUMENTS 1,653,535 A * 12/1927 Bonhajo ..... A44C 5/14 24/265 R
2,522,650 A * 9/1950 Valcourt ..... A44C 5/14 24/601.5
3,612,365 A * 10/1971 Dintsman ..... G04B 37/1493 24/265 WS (Continued)

FOREIGN PATENT DOCUMENTS

CN 1040687 A 3/1990
CN 202102258 U 1/2012
CN 203414738 U 1/2014
CN 206462525 U 9/2017

(Continued)

OTHER PUBLICATIONS

International Search Report dated Nov. 7, 2018 in PCT/EP2018/071553 filed on Aug. 8, 2018, 2 pages.

(Continued)

*Primary Examiner* — Robert Sandy
*Assistant Examiner* — Louis A Mercado
(74) *Attorney, Agent, or Firm* — Oblon, McClelland, Maier & Neustadt, L.L.P.

(57) ABSTRACT

A device for fixing a bracelet to a watch case includes at least one horn and a bracelet strand. The horn and the bracelet are held together by a bar. The horn includes a rigid blade arranged to fit together with at least one recess made in the bracelet strand. The at least one recess has an opening for receiving the blade during the placement of the bracelet strand so as to form a rigid link once the bar is put in place.

7 Claims, 2 Drawing Sheets

(56) References Cited

U.S. PATENT DOCUMENTS

| | | | | | |
|---|---|---|---|---|---|
| 3,965,670 | A * | 6/1976 | Ihringer | A44C 5/14 | 59/79.1 |
| 4,561,077 | A * | 12/1985 | Mock | G04B 37/1486 | 368/282 |
| 4,805,271 | A * | 2/1989 | Ripley | A44C 5/14 | 224/164 |
| 5,724,708 | A * | 3/1998 | Bert | A44C 5/14 | 224/164 |
| 5,951,193 | A * | 9/1999 | Yamamoto | A44C 5/105 | 24/265 B |
| 2006/0198248 | A1 | 9/2006 | Man | | |
| 2011/0197400 | A1 | 8/2011 | Chevrolet | | |
| 2013/0003510 | A1 | 1/2013 | Speichinger | | |
| 2018/0210491 | A1 | 7/2018 | Song et al. | | |

FOREIGN PATENT DOCUMENTS

| | | | |
|---|---|---|---|
| CN | 109275996 | A | 1/2019 |
| JP | H4-128613 | U | 11/1992 |
| JP | 2002-321 | A | 1/2002 |
| JP | 2008-281344 | A | 11/2008 |
| JP | 2009-156578 | A | 7/2009 |
| WO | WO 2017/023058 | A2 | 2/2017 |

OTHER PUBLICATIONS

First Office Action dated Dec. 18, 2020 in corresponding Chinese Patent Application No. 201880067916.5 (7 pages).

Notice of the Reason for Refusal dated Mar. 30, 2021 in corresponding Japanese Patent Application No. 2020-515653 (with English translation) (12 pages).

* cited by examiner

FIXING DEVICE FOR A BRACELET

CROSS-REFERENCE TO RELATED APPLICATION

The present application claims priority to European Patent Application No. 17197553.5 filed on Oct. 20, 2017, the entire content and disclosure of which are incorporated by reference herein.

FIELD OF THE INVENTION

The present invention relates to the field of horology or of jewelry. It more specifically relates to a device for fixing a bracelet to an object, in particular a watch case.

BACKGROUND OF THE INVENTION

In general, bracelets, made of leather or metal, are fixed to the horns of a watch case, by way of a bar formed by a tube, in which two pistons capable of moving in translation are mounted, as well as an elastic member disposed between said pistons and tending to drive them outwards towards the exterior of the tube. Said bar is mounted inside a recess provided for this purpose at one end of the bracelet, and the pistons are engaged inside blind bores made facing one another in the horns of the case.

The placement and removal of a bracelet using this fixing mode requires the use of tools in order to retract and hold the piston. Such an operation requires a degree of dexterity. Moreover, when the bar is successfully inserted between the horns, the hole made in the horns must be located in order to allow the spring to insert this pin therein.

Such fixing modes do not allow for proper integration of the bracelet with the middle part, with gaps or defects that may be visible at the junction.

Moreover, these fixing modes provide the bracelet with too much freedom of movement once attached to the watch, which can be detrimental to the proper holding of the watch on the wrist of the wearer according to the morphology thereof.

SUMMARY OF THE INVENTION

The present invention overcomes these drawbacks by proposing a device for fixing a bracelet to a watch case, the device comprising, on the one hand at least one horn, and on the other hand a bracelet strand, the horn and the bracelet being held together by means of a bar, the horn comprising a rigid blade arranged to fit together with at least one recess made in the bracelet strand, said at least one recess having an opening for receiving said blade during the placement of the bracelet strand so as to form a rigid link, once the bar has been put in place, and a passage through which said bar passes in order to hold the bracelet strand on the watch case.

According to other advantageous alternative embodiments of the invention, the bracelet strand comprises a rigid insert, said insert comprising the recess for receiving said blade.

According to other advantageous alternative embodiments of the invention:

- the blade is inclined downwards by an angle that lies in the range 20° to 45° relative to the median plane M of the watch case;
- the width of the blade is less than or equal to the width of the median horn;

- the horn comprises a banking element defining the hooking position of the bracelet strand with the watch case;
- the bracelet strand is made of a flexible plastics material and the insert is made of a hard material selected from the group consisting of metal materials or metal alloys, ceramics, or composite materials.

BRIEF DESCRIPTION OF THE DRAWINGS

Other characteristics and advantages of this invention will more clearly emerge upon reading the following detailed description of one example embodiment of a fixing device for a bracelet according to the invention, said example being provided for the purposes of illustration only and not intended to limit the scope of the invention, given with reference to the accompanying drawing, wherein.

DETAILED DESCRIPTION OF THE PREFERRED EMBODIMENTS

Figure 1A:
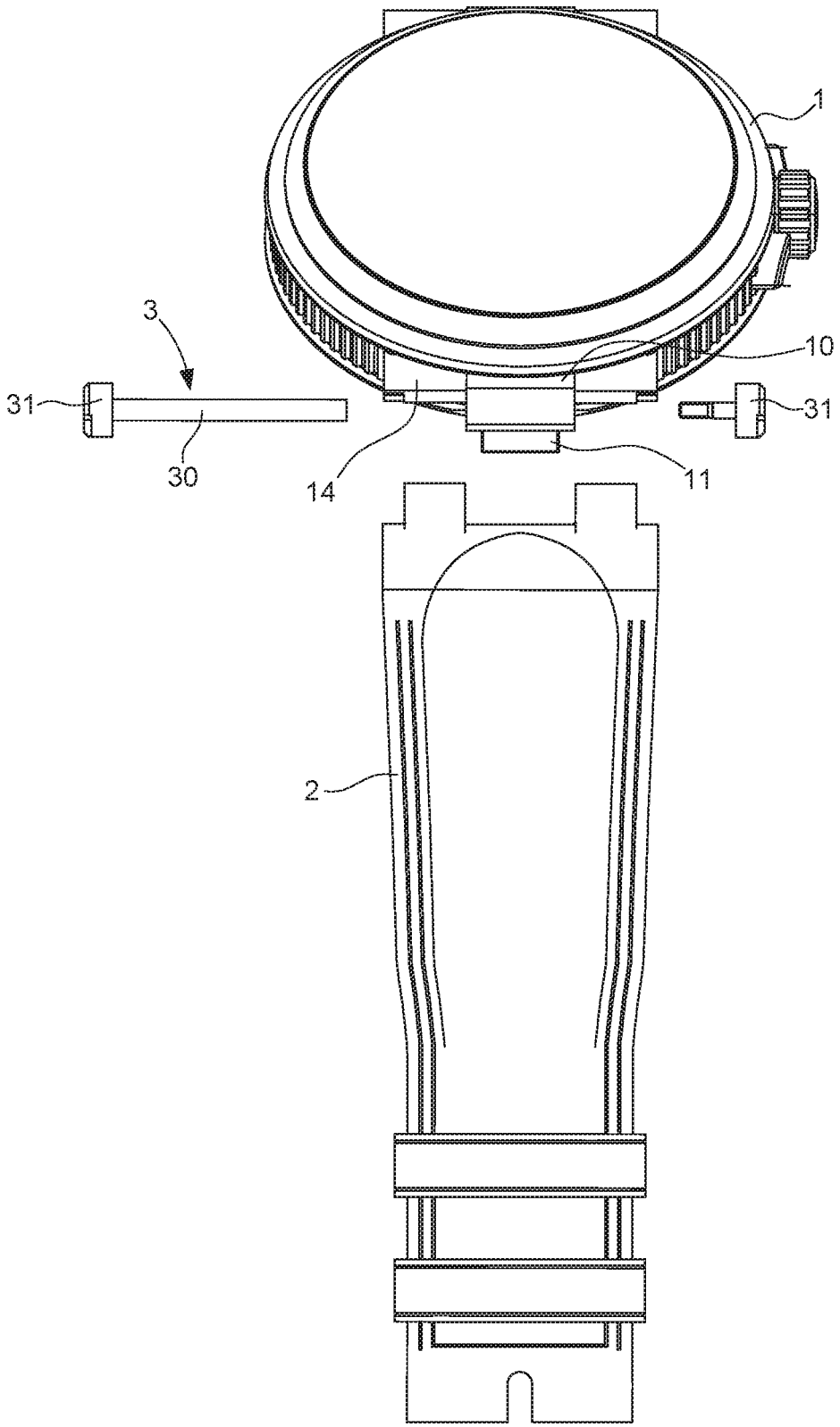
FIGS. 1*a* and 1*b* respectively show perspective views of a watch case equipped with a fixing device according to the invention.

FIG. 1*a* shows a watch case 1, to which at least one end of a bracelet strand 2 is intended to be connected in a removable manner.

Figure 1B:
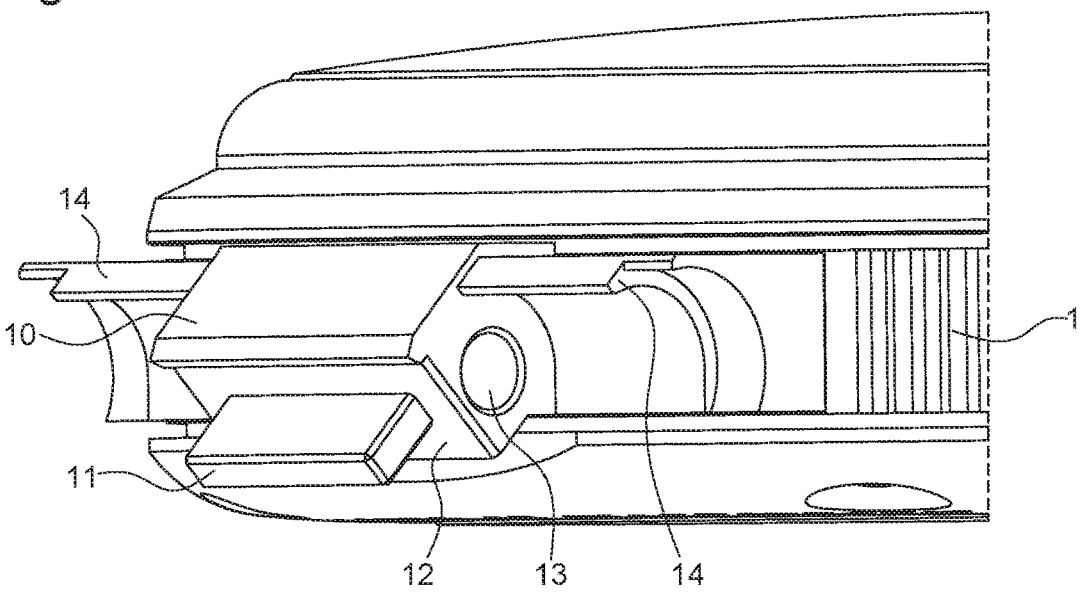
Figure 2A:
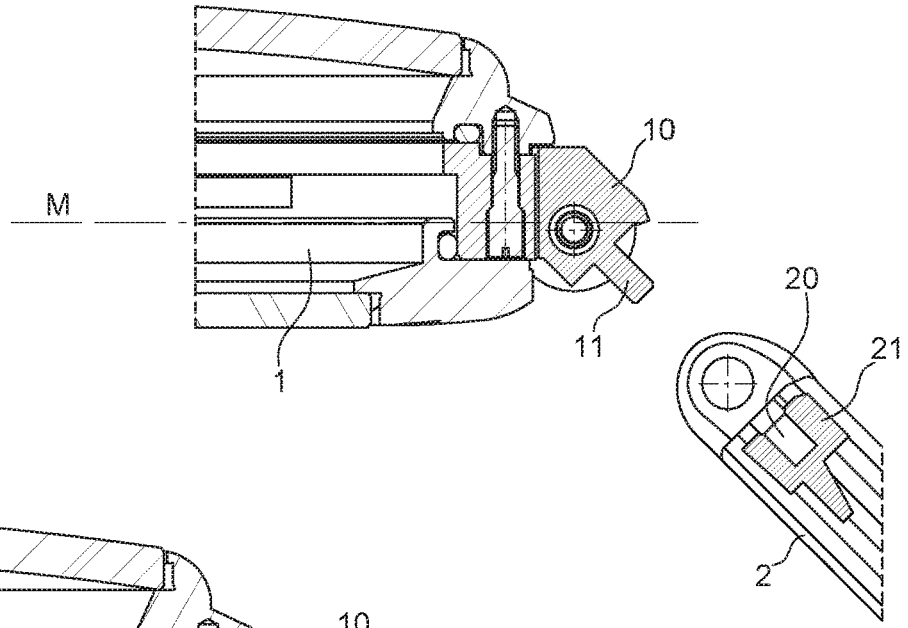
FIGS. 2*a* and 2*b* show the same watch case, from a sectional view, respectively before and after fixing the bracelet thereof.
Figure 2B:
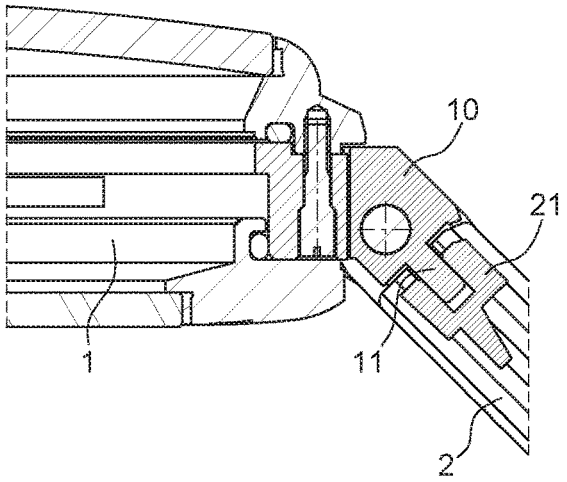

The linking device that is the subject of the invention is shown in FIGS. 1*b*, 2*a* and 2*b*. The device comprises, on the one hand, at least one horn 10, and on the other hand a bracelet strand 2, the horn 10 and the bracelet 2 being held together by means of a bar 3.

The horn 10 comprises a rigid blade 11 arranged to fit together with at least one recess 20 made in the bracelet strand, the recess 20 having an opening for receiving the blade during the placement of the bracelet strand so as to form a rigid link once the bar 3 is put in place.

In order to limit the travel of the blade 11, the horn 10 includes a flat surface 12 acting as a banking, the bracelet strand being pressed against this surface when the blade 11 is inserted into the bracelet 2, the flat surface 12 thus defining the hooking position of the bracelet strand with the watch case.

The horn 10 further comprises lateral shoulders 14, adjacent to the horn, and intended to partially cover the edges of the bracelet strand, thus preventing any gap from being visible at the link with the bar 3.

As shown in FIG. 1*b*, the median horn comprises a passage 13, the diameter whereof corresponds to the diameter of the axis of the bar 3 such that it is free to rotate inside the passage.

The bar 3 is formed by a cylindrical rod 30 having a flange 31 at each of the ends of the bar, the bar 3 and the flanges 31 thus forming a single element once assembled together. The flange 31 could be assembled at the end of the bar 4 by way of an insertion point mounted in a hollow part of the bar 3. An inner bulge is thus made at the end of the bar 3 in order to engage with the insertion point, so as to clip the flange inside the bar. Other modes for fixing the flanges 31 can be considered, such as bonding, welding or even driving in, for example. The latter act as axial retaining elements for the bracelet.

Advantageously, the flanges 31 of the bar 3 are housed at the lateral shoulders such that the flanges are not projecting once the bar 3 has been mounted.

According to the invention, the bracelet strand 2 comprises a rigid insert 21, the insert comprising the recess 20 for receiving the blade 11 of the horn 10, the two elements forming a rigid link once the bracelet strand has been assembled with the case.

As shown in FIGS. 2*a* and 2*b*, the blade 11 is inclined downwards by an angle that lies in the range 20° to 45° relative to the median plane M of the watch case, such an inclination being necessary for the strand to be correctly positioned once the watch has been placed on the wrist.

The width of the blade is provided such that it is less than or equal to the width of the median horn, and comprises a length that is substantially identical to the depth of the recess 20 of the insert 21 so as to prevent any clearance after assembly.

According to the preferred embodiment shown in FIG. 2*a*, the insert 21 and the blade 11 are made of a hard material selected from the group consisting of metal materials or metal alloys, ceramics or composite materials. The bracelet can be made of a flexible plastics material, or of a hard material mentioned hereinabove. A person skilled in the art will not encounter any particular difficulties in machining a recess 20 in a metal link, for example.

In order to fix the bracelet 2 to the case 1 as shown in FIG. 2*b*, the end of one strand is inserted, at the horn 10, by bringing the opening of the recess 20 to face the blade 11 in order to house the blade 4 inside the insert 21 of the bracelet strand.

Once the blade 11 has been partially positioned inside the insert 21, the user pushes the strand 2 until it abuts against the flat surface 12 of the horn 10.

The user then must simply place the bar 3 by successively passing it through the strand 2 and the horn 10 until the flanges 31 are positioned in abutment against the edges of the strand 2 and beneath the shoulders 14 adjacent to the horn 10.

In this manner, the carrier has a bracelet with no clearance once assembled and that is properly held in place when the watch is being worn.

In the aforementioned embodiment, the insert is disposed on a bracelet made of leather, synthetic fabric, plastic, metal, ceramic or even composite material. Similarly, the bar 4 is preferably made of metal but also could be made of plastic, ceramic or even composite material.

According to another embodiment, the rigid blade 11 and the recess 20 are inverted. The bracelet strand 2 comprises a rigid blade 11 arranged to fit together with at least one recess 20 made in the horn 10, said at least one recess 20 having an opening for receiving said blade 11 during the placement of the bracelet strand so as to form a rigid link once the fixing means are put in place.

It goes without saying that the present invention is not limited to the example shown and that various alternatives and modifications that may be apparent to a person skilled in the art can be made thereto.

The invention claimed is:

1. A device for fixing a bracelet to a watch case, the device comprising:

at least one horn and a bracelet strand, the horn and the bracelet strand being held together by a bar, the horn comprising a rigid blade protruding from the horn, arranged to fit together with at least one recess made in the bracelet strand, said at least one recess having an opening for receiving said blade during placement of the bracelet strand so as to form a rigid link, the horn comprising a passage through which said bar passes in order to hold the bracelet strand on the watch case, wherein the bracelet strand comprises a rigid insert, said insert comprising said recess for receiving said blade.

2. The device according to claim 1, wherein said blade is inclined downwards by an angle that lies in a range of 20° to 45° relative to a median plane M of the watch case.

3. The device according to claim 1, wherein a width of the blade is less than or equal to a width of the at least one horn.

4. The device according to claim 1, wherein the at least one horn comprises a banking element defining a hooking position of the bracelet strand with the watch case.

5. The device according to claim 1, wherein the bracelet strand is made of a flexible plastics material and the insert is made of a hard material selected from the group consisting of metal materials or metal alloys, ceramics, or composite materials.

6. The device according to claim 1, wherein the at least one horn further comprises lateral shoulders adjacent to the at least one horn, and the lateral shoulders partially cover edges of the bracelet strand to prevent any gap at the link with the bar.

7. The device according to claim 1, wherein the horn includes a flat surface at an opposite end from the watch case, the rigid blade protrudes from the flat surface of the horn, and the bracelet strand abuts the flat surface and the rigid blade is positioned inside of the at least one recess made in the bracelet strand.

* * * * *